United States Patent [19]

Walker et al.

[11] Patent Number: 4,498,354

[45] Date of Patent: Feb. 12, 1985

[54] AUTOMATIC LOCK FOR TWO MODE PISTON PUMP

[75] Inventors: Wellington J. Walker, Kensington, Conn.; George M. Whitehouse, deceased, late of Wallingford, Conn., by Barbara J. Whitehouse, executor

[73] Assignee: LFE Corporation, Waltham, Mass.

[21] Appl. No.: 440,268

[22] Filed: Nov. 9, 1982

[51] Int. Cl.[3] ..... F04B 35/00

[52] U.S. Cl. ..... 74/625; 74/527; 74/570; 403/355; 417/374

[58] Field of Search ..... 74/625, 570, 44, 105, 74/527; 417/374; 403/355, 154

[56] References Cited

U.S. PATENT DOCUMENTS

| | | | |
|---|---|---|---|
| 718,001 | 1/1903 | Jones | 74/625 |
| 1,098,520 | 6/1914 | Myers | 74/625 |
| 2,426,001 | 8/1947 | Denault | 74/527 X |
| 2,684,488 | 7/1954 | Snyder | 74/625 X |
| 4,194,412 | 3/1980 | Boyer | 74/527 X |
| 4,318,442 | 3/1982 | Livesay | 74/570 X |
| 4,400,143 | 8/1983 | O'Connor | 417/374 |
| 4,441,865 | 4/1984 | Staisch | 74/570 X |

*Primary Examiner*—Rodney H. Bonck
*Assistant Examiner*—David D. House
*Attorney, Agent, or Firm*—Lahive & Cockfield

[57] ABSTRACT

A two mode operable piston pump has a cam lock with a shaft biased into the drive axial passage of a cam shaft to lock the cam shaft to a lever body, a lock edge on the lever body engaging a flat on a head portion of the cam lock. Inserting a power tool into the drive axial passage opposite the head pushes the shaft up and releases the cam shaft for operation of the pump in a power mode.

5 Claims, 5 Drawing Figures

AUTOMATIC LOCK FOR TWO MODE PISTON PUMP

BACKGROUND

This invention relates generally to piston pumps and particularly to an assembly for locking piston pumps adapted to be driven either by a power tool or by manual power.

In some cases it is desirable to be able to operate a piston pump, such as that found on some aircraft to provide hydraulic pressure, either by hand, if necessary, or by a power tool, if it is available and convenient to use. It is necessary to be able to lock the pump into one or the other of these modes of operation. Accordingly, it is an object of this invention to provide a locking assembly for such operation of the pump that is efficient, inexpensive, easy to use, and reliable.

SUMMARY OF THE INVENTION

The invention comprises a lock assembly for a two mode piston pump comprising a pump housing including a cylinder, a piston mounted for reciprocal movement within the cylinder, and a piston rod fixed to the piston and extending out of the pump housing for reciprocal movement to operate the piston. The lock assembly comprises a connecting link pivotally connected to the piston rod, lever means pivotally mounted on the pump housing, cam means having a cylindrical outer surface rotatably mounted in the connecting link for effecting reciprocal movement of the connecting link, cam shaft means fixed, off-center, to the cam means and rotatably mounted within the lever means, the cam shaft means having an axial passage with a square cross-section for engagement by a power tool square drive shaft, a cam locking means for locking the cam shaft means to the lever means for operation of the pump by pivotal movement of the lever means with respect to the pump housing, the cam locking means comprising a shaft portion adapted to be insertable in the cam shaft means axial passage, and a head portion fixed to the shaft portion, the cam locking means shaft portion having a first position in the axial passage in which the cam shaft means is locked to the lever means, and a second position in the axial passage in which the cam shaft means is unlocked, and a lever locking means for locking the lever means to the housing.

In a preferred embodiment, the lock assembly includes bias means for biasing the cam locking means toward the first position, the head portion is generally circular and includes a surface portion defining a flat, a lock means is mounted on the lever means and includes a second surface portion for engaging the flat when the cam locking means shaft portion is in the first position, and the cam locking means shaft portion extends through the cam shaft means axial passage in the first position and is adapted to be movable to the second position by insertion of the square drive of a power tool into the axial passage opposite the cam locking means head portion.

BRIEF DESCRIPTION OF THE DRAWING

Other objects, features and advantages of the invention will be described in, or be apparent from the following description of a preferred embodiment of the invetion, including the drawings, in which.

DESCRIPTION OF A PREFERRED EMBODIMENT

Figure 1:
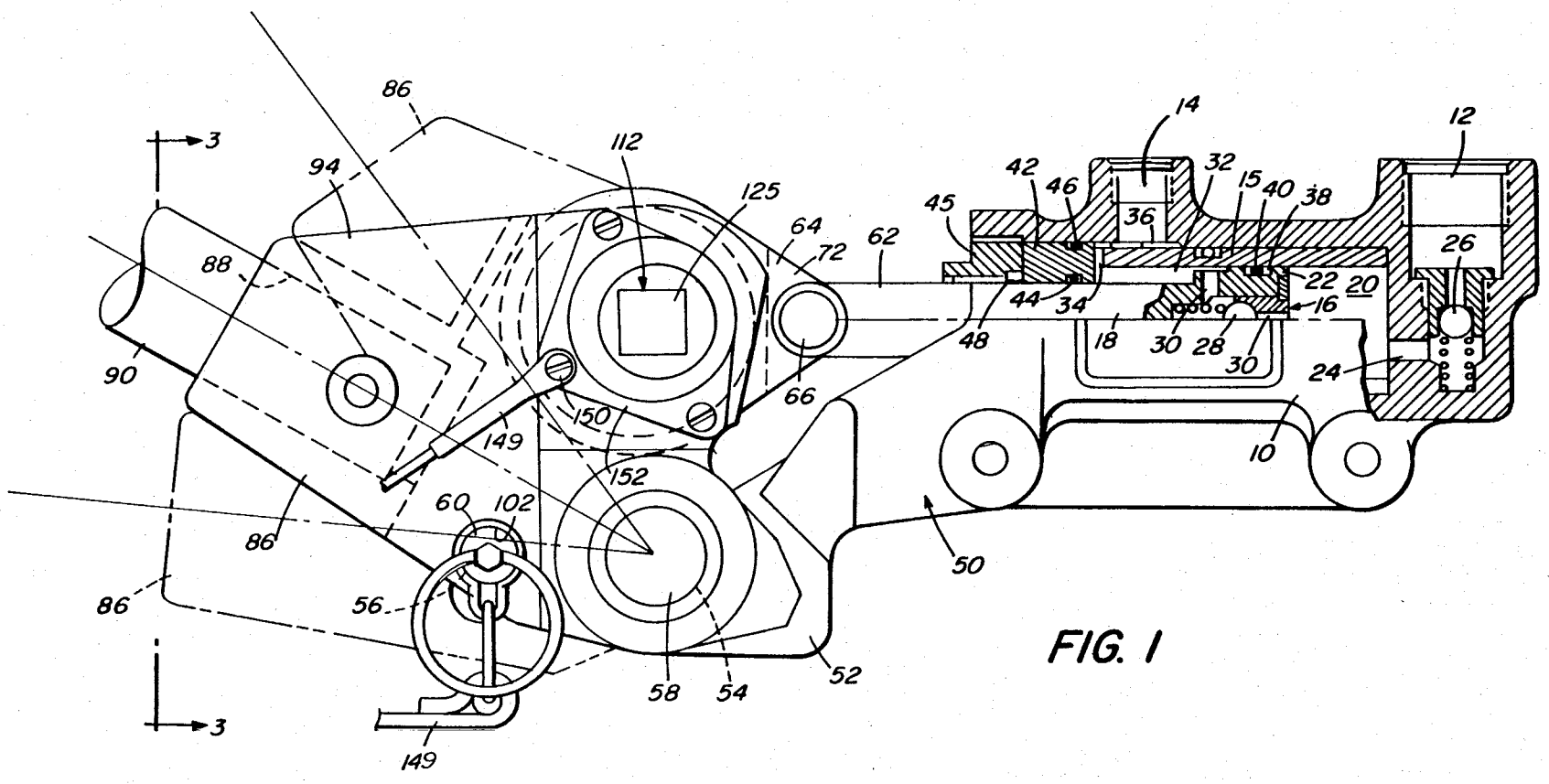
FIG. 1 is a side view, partially in section, of a pump embodying the invention.
Figure 2:
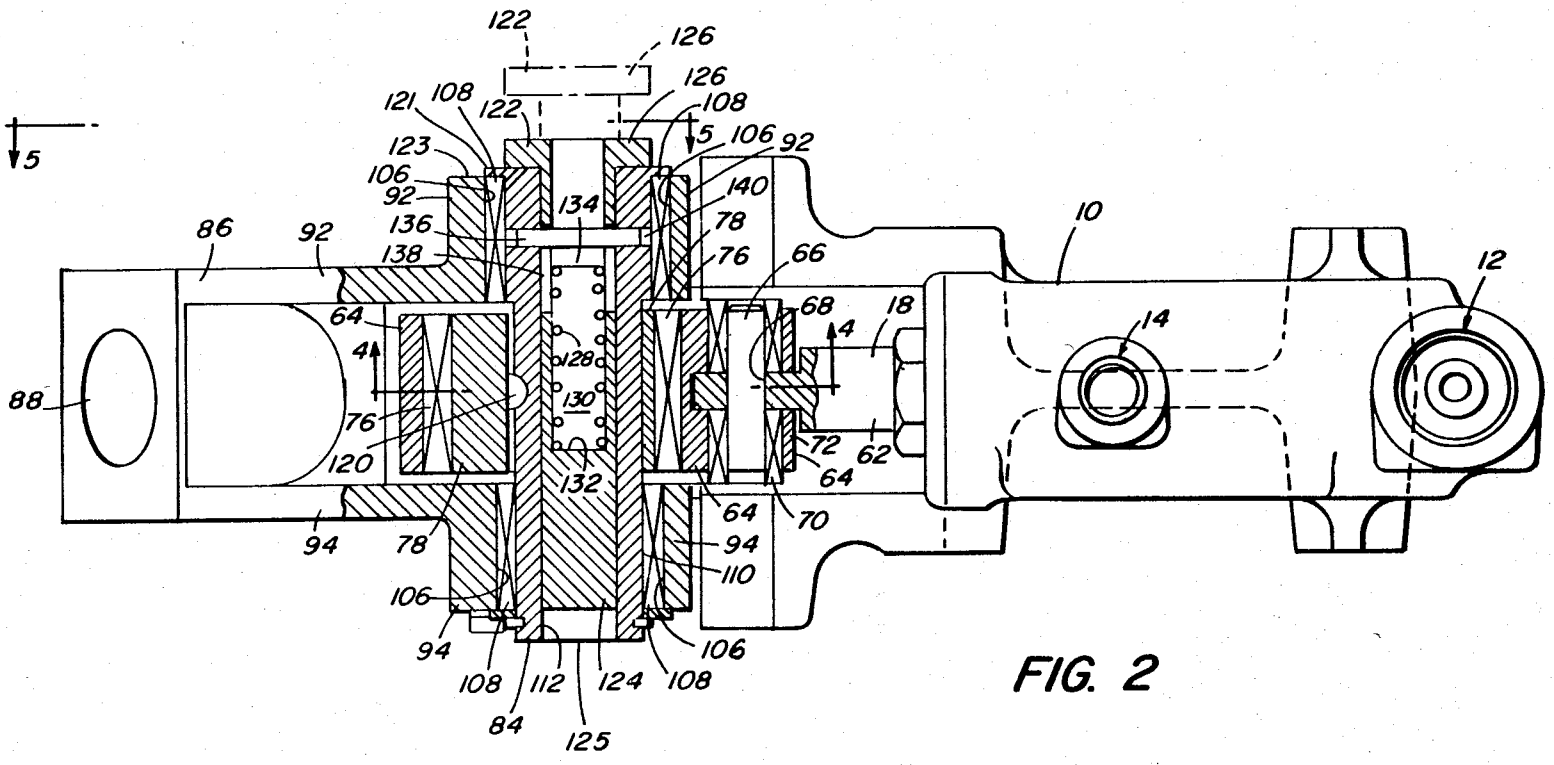
FIG. 2 is a front view, also partially in section, of the pump of FIG. 1.
Figure 3:
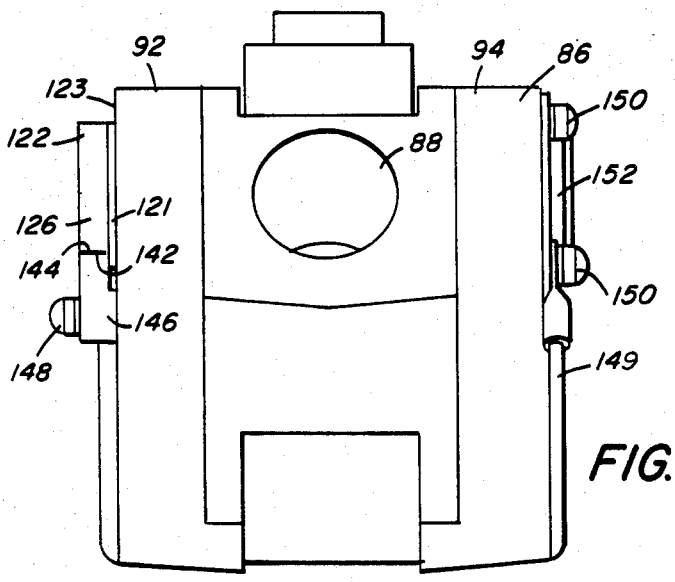
FIG. 3 is a bottom view of the pump of FIG. 1.

FIGS. 1, 2 and 3 show a double acting piston pump with a housing 10 having an inlet, or suction, port 12, and an outlet, or pressure port 14. A sleeve 15 within the housing 10 forms a piston cylinder for a piston 16 fixed to a piston rod 18 having a cross-sectional area about one-half that of the piston 16. The suction port 12 communicates with the upper cylinder cavity 20 above the piston head 22 through an inlet passage 24 controlled by a first check valve 26. A second check valve 28 is located in the piston head 22 and controls flow through a piston head passage 30 that communicates between the upper cylinder cavity 20 above the piston head 22 and a lower cylinder cavity 32 below the piston head 22.

The lower cylinder cavity 32 below the piston head 22 communicates by way of outlet passages 34 at the bottom of the sleeve 15 to an outer annular cavity 36 communicating with the pressure port 14. The piston head 22 has an outside recess 38 for locating an appropriate sealing, piston O-ring 40. A seal housing 42, at the bottom of the pump housing 10, through which the piston rod 18 moves, includes recesses for a sealing, piston rod O-ring 44, and for a backup ring 46. A nut 45 below the seal housing 42 includes a recess for a scraper seal 48.

An extension 50 of the housing 10 forms a bottom pivot arm 52 with two holes 54, 56 through the pivot arm. One hole 54 is for passage of a pivot shaft 58. The other hole 56 is for passage of a manual lock quick release pin 60.

The end portion 62 of the piston rod 18 extending out of the seal portion 42 of the housing 10 is pivotally connected to a connecting link 64, by a shaft 66 passing through an opening 68 in the piston rod 18 and through bearings 70 seated in bifurcated arms 72 of the connecting link 64 on either side of the lower portion 62 of the piston rod 18. The connecting link 64 includes a circular hole 74, in which a ring bearing 76 is seated, for receiving a cam 78. (See FIG. 4) The cam 78 has a cylindrical outer surface 80 and an off-center axially directed cylindrical passage 82 for receiving a cam shaft 84.

Figure 5:
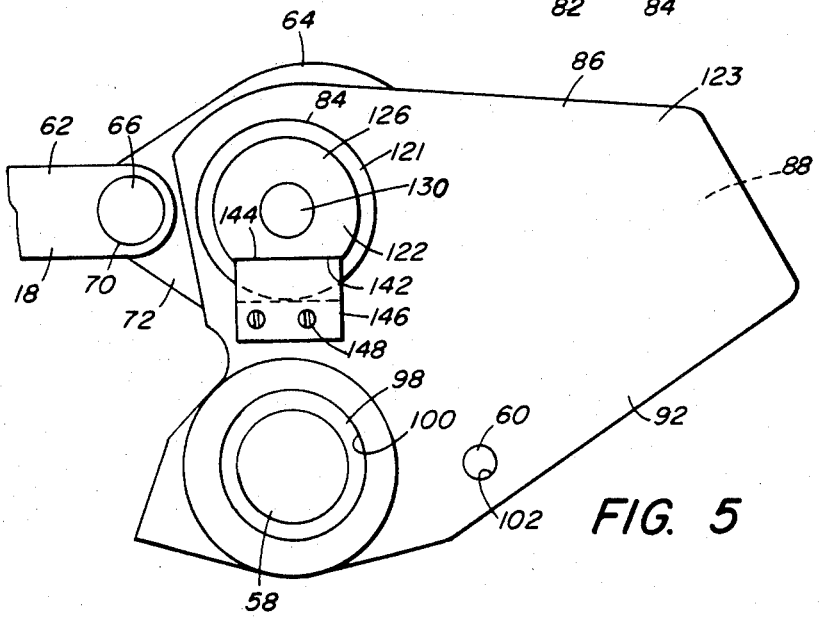
FIG. 5 is a side view of the lower portion of the pump from the opposite side.

A lever body 86 has a bottom crank arm receptacle 88 for receiving a crank arm 90, and bifurcated upper lever arms 92, 94 located on either side of the pivot arm 52 and of the connecting link 64. The lever body 86 is pivotally mounted on the pivot arm 52 by a lever pivot shaft 58 passing through the pivot arm 52 and through bearings 98 seated in a pair of holes 100 in the lever arms 92, 94. (See FIG. 5) Another pair of holes 102 in the lever arms 92, 94 may be aligned with the quick release pin hole 56 in the pivot arm 52 so that the quick release pin 60 may be inserted through all three holes 56, 102 to lock the lever body 86 to the pivot arm 52 of the housing 10 and prevent movement of the lever body 86 with respect to the housing 10.

Another pair of holes 106 in the lever arms 92, 94 provides seatings for bearings 108 through which the cam shaft 84 passes. The cam shaft 84 has a cylindrical outer surface 110 and a central, square axial passage 112 for engagement by the square drive of a power tool (not shown in the drawings). The cam shaft 84 passes through the off-center passage 82 of the cam 78; a recess 114 on the outside of the cam shaft 84 corresponds to a slot 116 in the interior surface 118 of the cam 78 for insertion of a key 120 to lock the cam 78 to the cam shaft 84 so that the cam 78 rotates with rotation of the cam shaft 84. A narrow flange 121 at one end of the cam shaft 84 is seated against the outside surface 123 of one of the lever arms 92.

A lock pin 122 has a shaft 124 with a square outside cross-section for sliding insertion into the square passage 112 of the cam shaft 84, and a head 126. When the lock pin 122 is fully inserted into the cam shaft passage 82, the lock pin head 126 rests against the cam shaft flange 121 and is close to the outside surface 123 of lever arm 92. The lock pin shaft 124 extends through the length of the cam shaft passage 112, preventing the insertion of a square tool into the end 125 of the cam shaft passage 112 opposite the lock pin head 126. The lock pin 122 is biased toward this inserted position by a spring 128 located in an interior cavity 130 of the lock pin 122 between the bottom 132 of the cavity 130 and a plug 134. The plug 134 is held in place by a pin 136 passing through slots 138 in the wall of the lock pin 122 into pin-seating holes 140 in the interior of the cam shaft 84.

The lock pin head 126 is generally circular except for a cut-off portion forming a flat 142. When the lock pin 122 is inserted in the cam shaft 84, the flat 142 of the lock pin head is aligned with an edge 144 of the lock 146 mounted with screws 148 onto the outside surface 123 of lever body arm 92. When the lock pin 122 is thus fully inserted, the cam 78 and cam shaft 84 are locked to the lever arm 92.

The piston pump operates by movement of the piston 16. As the piston 16 moves down, on a down stroke, away from the suction port 12, the first check valve 26 is open because of reduced pressure in the upper cylinder cavity 20 above the piston head 22, and fluid enters the cavity 20 through the suction port 12 and the first check valve 26. Furthermore, as the piston 16 moves down, fluid in the lower cylinder cavity 32 below the piston head 22 is forced out the pressure port 14 by way of the sleeve outlet passages 34 and the outer annular cavity 36. During this time, the second check valve 28, in the piston head 22, is closed.

As the piston 16 moves up, toward the suction port 12, the increased pressure in the upper cylinder cavity 20 closes the first check valve 26, trapping fluid in the upper cylinder cavity 20. The fluid in the upper cavity 20 opens the second check valve 28 in the piston head 22 as the piston 16 moves up. Fluid in the upper cavity 20 flows through the second check valve 28 and the piston head passage 30 to the lower cylinder cavity 32. The effective cross-sectional area of the lower cylinder cavity 32 is less than that of the upper cylinder cavity 20 because of the space occupied below the piston head 22 by the piston rod 18. The fluid passing from the upper cavity 20 to the lower cavity 32 fills it and then passes out through the pressure port 14. Thus fluid is forced out through the pressure port 14 on the up stroke as well as the down stroke of the piston 16.

On the next down stroke of the piston 16, fluid is again drawn into the upper cavity 20 through the suction port 12 and the process is repeated.

The movement of the piston, in the embodiment shown, may be obtained either by manual manipulation or by use of a power tool, such as an air motor with a square drive (not shown).

In the manual operation mode, crank arm 90 several inches (e.g. 30 inches) long is inserted into the lever body crank arm receptacle 88. The quick release pin 60 is removed, making the lever body 86 pivotable about the lever pivot shaft 58. The quick release pin 60 is secured against loss by a cable 149 mounted on one of the screws 150 securing a cover 152 surrounding the cam shaft passage end 125. The lock pin 122, in the manual operation mode, is maintained in the position in which it is fully inserted into the cam shaft passage 112. In this fully inserted position, the lock pin 122, in contact with the lock 146, holds the cam 78 to the same position relative to the lever body 86. Moving the crank arm 90 back and forth through approximately a 50° angle pivots the lever body 86 about the lever pivot shaft 58 (as shown by the dashed line outlines of the lever body 86 in FIG. 1) and transmits axial motion to the piston rod 18 to operate the piston 16.

To operate the pump in the power tool mode, the lever body 86 is brought to a position in which the quick release pin 60 may be inserted through the holes 102 of the lever arms 92, 94 and the hole 56 in the pivot arm 52. With the quick release pin 60 thus inserted, the lever body 86 is locked to the pivot arm 52, and the crank arm 90 cannot move relative to the housing 10. When the square drive power tool is inserted into the square drive engagement passage 112 of the cam shaft 84, it forces the lock pin 122 out from its biased, fully inserted position, compressing spring 128. The lock pin head 126 is thereby moved away from the surface 123 of the lever arm 92 thereby causing disengagement from the lock 146 (as shown by the dashed line outline of lock pin head 126 in FIG. 2). Accordingly, the cam shaft 84 which is locked to the cam 78 by the key 120, is free to rotate relative to the lever body 86. The rotating motion of the square drive of the power tool may then turn the cam shaft 84 with the cam 78. The effect of rotation of the cam 78 is to transmit axial movement to the piston rod 18 by way of the connecting link 64.

Figure 4:
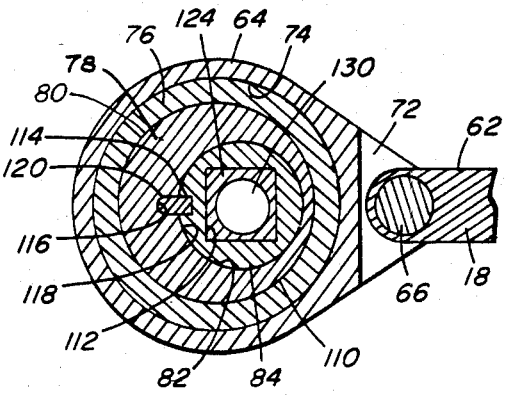
FIG. 4 is a sectional view of the pump's connecting link.

When the manual mode is locked by inserting the quick release pin 60, the center line of the piston rod 18 passes through the center of the cam shaft 84. This allows optimum performance in the powered mode. When the square drive of the power tool (not shown) is removed from the square axial passage 112 the cam 78 position is locked to optimize the relationship between crank arm 90 stroke and torque in the manual mode (as shown in FIG. 4). In the preferred embodiment, shown in FIGS. 1–5, the piston stroke is longer in the manual mode of operation than in the powered mode of operation. However, the design concept does not restrict the relationship to powered mode piston stroke length.

The length of the lock pin shaft 124 may be extended out beyond (a distance greater than the thickness of lock 146) the end 125 of the cam shaft passage 112. This would insure complete disengagement of the lock pin 122 from the lock 146 before the square drive of the power tool can engage the cam shaft passage 112.

Modifications of the illustrated embodiment described above may be conceived by those skilled in the art without departing from the spirit of the invention as defined by the following claims.

It is claimed:

1. A lock assembly for a two mode piston pump comprising a pump housing including a cylinder, a piston mounted for reciprocal movement within said cylinder, and a piston rod fixed to said piston and extending out of said pump housing for reciprocal movement to operate said piston, wherein said assembly comprises:

a connecting link pivotally connected to said piston rod, lever means pivotally mounted on said pump housing, cam means, having a cylindrical outer surface, rotatably mounted in said connecting link for effecting reciprocal movement of said connecting link, cam shaft means fixed, off-center, to said cam means and rotatably mounted within said lever means, said cam shaft means having an axial passage with a square cross-section for engagement by a power tool square drive shaft, a cam locking means for locking said cam shaft means to said lever means for operation of said pump by pivotal movement of said lever means with respect to said pump housing, said cam locking means comprising a shaft portion adapted to be insertable in said cam shaft means axial passage, and a head portion fixed to said shaft portion, said cam locking means shaft portion having a first position in said axial passage in which said cam shaft means is locked to said lever means and a second position in said axial passage in which said cam shaft means is unlocked, and a lever locking means for locking said lever means to said pump housing.

2. The lock assembly of claim 1 further including a lock means mounted on said lever means and adapted to prevent rotation of said head portion with respect to said lever means when said cam locking means shaft portion is in said first position.

3. The lock assembly of claim 2 wherein said head portion is generally circular and includes a surface portion defining a flat, said lock means mounted on said lever means comprising a second surface portion for engaging said flat when said cam locking means shaft portion is in said first position.

4. The lock assembly of claim 1 including bias means for biasing said cam locking means toward said first position.

5. The lock assembly of claim 1 wherein said cam locking means shaft portion extends through said cam shaft means axial passage in said first position and is adapted to be movable to said second position by insertion of the square drive of a power tool in said axial passage opposite said cam locking means head portion.

* * * * *